US009936745B2

(12) United States Patent
Faddoul

(10) Patent No.: US 9,936,745 B2
(45) Date of Patent: Apr. 10, 2018

(54) COMPOSITE GARMENT WEARABLE IN A MULTITUDE OF OUTFIT VARIATIONS

(71) Applicant: Leila Rose Faddoul, Plymouth (GB)

(72) Inventor: Leila Rose Faddoul, Plymouth (GB)

(73) Assignee: KAMELEON ROSE LIMITED, Plymouth (GB)

( * ) Notice: Subject to any disclaimer, the term of this patent is extended or adjusted under 35 U.S.C. 154(b) by 112 days.

(21) Appl. No.: 14/719,236

(22) Filed: May 21, 2015

(65) Prior Publication Data

US 2016/0338430 A1 Nov. 24, 2016

(51) Int. Cl.

| | |
|---|---|
| ***A41D 15/00*** | (2006.01) |
| ***A41D 1/22*** | (2018.01) |
| ***A41D 1/18*** | (2006.01) |
| ***A41D 1/06*** | (2006.01) |
| ***A41F 1/00*** | (2006.01) |
| ***A41D 1/14*** | (2006.01) |
| ***A41D 3/08*** | (2006.01) |

(52) U.S. Cl.

CPC ..... *A41D 15/00* (2013.01); *A41D 1/06* (2013.01); *A41D 1/14* (2013.01); *A41D 1/18* (2013.01); *A41D 1/22* (2013.01); *A41D 3/08* (2013.01); *A41F 1/004* (2013.01)

(58) Field of Classification Search

CPC ..... A41D 15/00; A41D 15/02; A41D 15/005; A41D 15/04; A41D 15/002

See application file for complete search history.

(56) References Cited

U.S. PATENT DOCUMENTS 1,250,004 A * 12/1917 Phillip ..... A41D 15/02 2/213
1,629,561 A * 5/1927 Wellstatter ..... A41D 15/02 2/213
1,784,369 A * 12/1930 Lowenbaum ..... A41D 1/22 2/212
1,794,307 A * 2/1931 Lowenbaum, Jr. ..... A41D 1/22 2/72
1,807,908 A * 6/1931 Freed ..... A41B 9/08 2/213
1,999,010 A * 4/1935 Tait ..... A41D 7/00 2/88
2,010,787 A * 8/1935 Mendel ..... D04B 21/18 450/66

(Continued)

*Primary Examiner* — Bobby Muromoto, Jr.
(74) *Attorney, Agent, or Firm* — Symbus Law Group, LLC; Clifford D. Hyra

(57) ABSTRACT

A composite garment includes a skirt, being a loose piece of material of a bell-shaped longitudinal configuration fitting around the body of a wearer from the waist downward to proximate the knees, and a bodice, being a tubular-shaped piece of material of an hour-glass longitudinal configuration fitting around the body from below the hips upward to the arm pits. Button holes are spaced apart in one of front and back portions of a hem of the skirt. Buttons are spaced apart on the other of front and back portions of the skirt hem so as to allow fitting some buttons through some button holes and thereby closing of the skirt at the hem either between the wearer's legs so as to convert the skirt into either trousers or along the wearer's shoulders and arms so as to convert the skirt into blouse.

20 Claims, 23 Drawing Sheets

(56) References Cited

U.S. PATENT DOCUMENTS 2,080,814 A * 5/1937 Foltz ..... A41D 1/14 2/212
2,529,774 A * 11/1950 Landau ..... A41B 9/16 2/109
2,721,327 A * 10/1955 Finkel ..... A41D 1/18 2/105
2,744,253 A * 5/1956 Freedman ..... A41D 15/00 2/69.5
2,794,986 A * 6/1957 Anderson ..... A41D 7/00 450/27
2,877,770 A * 3/1959 Gold ..... A41C 1/06 2/73
2,879,515 A * 3/1959 Franklin ..... A41B 9/06 2/110
3,098,485 A * 7/1963 Howell ..... A41C 3/08 2/73
3,493,973 A * 2/1970 Armstrong ..... A41D 1/00 2/74
3,877,078 A * 4/1975 Tepper ..... A41D 1/06 2/106
4,104,742 A * 8/1978 Rahaim ..... A41D 15/02 2/213
4,106,125 A * 8/1978 Palumbo ..... A41D 15/02 2/213
4,142,253 A * 3/1979 Roscoe ..... A41D 1/22 2/74
4,190,908 A * 3/1980 Herskind ..... A41D 1/06 2/213
4,683,595 A * 8/1987 Cash ..... A41D 15/00 2/105
4,731,884 A * 3/1988 Lawrence ..... A41D 15/00 2/105
4,766,613 A * 8/1988 Wells ..... A41D 15/002 2/227
4,774,726 A * 10/1988 Garrett ..... A41D 1/22 2/105
5,150,478 A * 9/1992 Niedajkasza ..... A41D 15/00 2/243.1
5,575,006 A * 11/1996 Wolfe ..... A41D 13/1254 2/114
5,864,888 A * 2/1999 Archer ..... A41D 1/082 2/227
6,205,585 B1 * 3/2001 Capparelli ..... A41B 9/06 2/106
7,780,502 B2 * 8/2010 Calamari ..... A41B 9/06 2/105
7,814,574 B2 * 10/2010 Gheneva ..... A41D 1/06 2/227
7,878,880 B2 * 2/2011 Hendrickson ..... A41D 1/205 2/104
8,051,496 B2 * 11/2011 Hersh ..... A41D 7/00 2/67
8,104,099 B2 * 1/2012 Olmos Plaza ..... A41D 15/02 2/211
8,241,088 B2 * 8/2012 Murphy ..... A41C 3/08 450/1
8,272,072 B1 * 9/2012 Fowler ..... A41D 15/00 2/263
8,549,666 B2 * 10/2013 Gheneva ..... A41D 1/06 2/106
8,832,867 B2 * 9/2014 Boyle ..... A41D 15/002 2/227
9,295,290 B1 * 3/2016 Solorzano ..... A41D 11/00
9,380,818 B2 * 7/2016 Tippett ..... A41D 15/002
9,572,381 B2 * 2/2017 Maryea ..... A41D 15/00
2006/0137075 A1 * 6/2006 Gheneva ..... A41D 1/06 2/227
2009/0265830 A1 * 10/2009 Hendrickson ..... A41D 1/205 2/104
2009/0265831 A1 * 10/2009 Hendrickson ..... A41C 3/04 2/104
2009/0300817 A1 * 12/2009 Fata ..... A41D 1/22 2/74
2010/0058508 A1 * 3/2010 Hersh ..... A41D 7/00 2/67
2011/0016603 A1 * 1/2011 Gheneva ..... A41D 1/06 2/69
2013/0042381 A1 * 2/2013 Yonover ..... A41D 15/00 2/74
2014/0123365 A1 * 5/2014 Yoo ..... A41D 15/00 2/74
2014/0157478 A1 * 6/2014 Van De Velde ..... A41D 15/00 2/69
2015/0007377 A1 * 1/2015 Pavalon ..... A41D 3/08 2/69
2015/0327605 A1 * 11/2015 Tippett ..... A41D 1/08 2/212
2015/0351474 A1 * 12/2015 Farmer ..... A41D 31/02 2/67
2016/0029718 A1 * 2/2016 Darnell ..... A47G 9/062 34/91
2016/0037837 A1 * 2/2016 Ferrara ..... A41D 15/00 2/67
2016/0174621 A1 * 6/2016 James ..... A41D 15/00 2/102

* cited by examiner

FRONT

PROFILE

BACK

FRONT

PROFILE

BACK

FRONT

PROFILE

BACK

BACK

PROFILE

FRONT

COMPOSITE GARMENT WEARABLE IN A MULTITUDE OF OUTFIT VARIATIONS

FIELD

The present invention relates to clothing and apparel, and more particularly, is concerned with a composite garment wearable in a multitude of outfit variations.

BACKGROUND

Fashion trends continually change, in women's clothing and apparel especially. Styles of tops, skirts and pants, as well as hemlines, necklines, and sleeve lengths can vary dramatically from one year to the next. Adding to one's wardrobe in order to follow these changes in fashion presents problems in terms of the money, time and space required.

A potential solution to these problems is being sought in the prior art. For example, in U.S. Pat. No. 6,205,585 a garment in the form of a piece of fabric, having snaps at upper left and right hand corners thereof, when assembled with an elastic band and a scarf, gives the desired appearance of a single integral article of clothing, such as a shirt or blouse, for covering the upper torso of the wearer. Further, in U.S. Pat. App. Pub. No. 2013/0042381 a tube of stretchable fabric, by use with a looped band or bands, can be shaped into a selected one of many different wearable garment styles.

These disclosures appear to represent steps toward a potential solution to the aforementioned problems. There still remains a need in the art for an innovation that will move greatly beyond the attempted solutions found in the prior art.

SUMMARY

The present invention is an innovation that moves greatly beyond the attempted solutions of the prior art by providing a composite garment wearable in a multitude of different outfit variations, such as differing embodiments of dresses, skirts, trousers, tops, ponchos and jumpsuits.

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description. Rather, the scope of the invention is defined by the appended claims.

In certain embodiments, the disclosed embodiments may include one or more of the features described herein.

In one embodiment, a composite garment wearable in a multitude of outfit variations includes: a skirt formed by a loose piece of material of a bell-shaped longitudinal configuration that fits around the body of a wearer downward from proximate the waist to proximate the knees of the wearer, the skirt having a bottom hem with front and back portions; a bodice formed by a tubular piece of material of an hour-glass longitudinal configuration that fits around the body of the wearer upward from proximate the waist to proximate the arm pits of the wearer; a seam joining the bodice with the skirt; a plurality of button holes formed in a spaced apart relationship from one another in one of the front and back portions of the bottom hem of the skirt; and a plurality of buttons attached in a spaced apart relationship from one another on the other of the front and back portions of the bottom hem of the skirt so as to allow fitting of at least some of the buttons through at least some of the button holes and thereby closing of the skirt at the bottom hem thereof between the legs of the wearer so as to convert the skirt into a pair of trousers of one of above or below knee-length.

In one embodiment, the skirt has a top edge margin and ruffled portions proximate the top edge margin at a middle of a front and a back of the skirt.

In one embodiment, the bodice has open opposite ends such that the respective positions of the open opposite ends that are spaced above and below one another are reversible such that the bodice is configured to be worn in either of an upright or inverted orientation so as to place the skirt on the wearer in either one of below or above the bodice.

In one embodiment, the bodice has a top edge margin and a band of elastic material attached along the top edge margin so as to allow stretching and clinging of the bodice about the upper back and across the front bust of the wearer.

In one embodiment, at least top and bottom portions of the tubular-shaped piece of material forming the bodice is elastic so as to allow stretching and clinging of the bodice around regions of the body of the wearer above and below the waist of the wearer.

In one embodiment, a front vertical portion of the bodice is smocked with in an elasticated manner. The smocked front vertical portion of the bodice is wider at a first end than at an opposite second end thereof.

In one embodiment, a composite garment wearable in a multitude of outfit variations includes: a bodice formed by a tubular-shaped piece of material of an hour-glass longitudinal configuration that fits around the body of a wearer upward from proximate the waist to proximate the arm pits of the wearer, at least a portion of the tubular-shaped piece of material forming the bodice being elasticated so as to allow stretching and clinging of the bodice around regions of the body of the wearer above and below the waist of the wearer; a skirt formed by a loose piece of material of a bell-shaped longitudinal configuration that fits around the body of the wearer downward from the bodice to below the knees of the wearer, the skirt having a bottom hem with front and back portions; a seam joining the bodice with the skirt; a plurality of button holes formed in a spaced apart relationship from one another in one of the front and back portions of the bottom hem of the skirt; and a plurality of buttons attached in a spaced apart relationship from one another on the other of the front and back portions of the bottom hem of the skirt so as to allow fitting of at least some of the buttons through at least some of the button holes and thereby closing of the skirt at the bottom hem thereof between the legs of the wearer so as to convert the skirt into a pair of trousers of below knee-length.

In one embodiment, wherein at least a portion of the tubular-shaped piece of material forming the bodice is elasticated so as to allow stretching and clinging of the bodice around regions of the body of the wearer above and below the waist of the wearer.

In one embodiment, a composite garment wearable in a multitude of outfit variations includes: a bodice formed by a tubular-shaped piece of material of an hour-glass longitudinal configuration that fits around the body of the wearer downward from above the waist to below the hips of the wearer; a skirt formed by a loose piece of material of a bell-shaped longitudinal configuration that fits around the body of the wearer upward from the bodice to proximate the shoulders of the wearer, the skirt having a hem at the shoulders of the wearer with front and back portions; a seam joining the bodice with the skirt; a plurality of button holes formed in a spaced apart relationship from one another in one of the front and back portions of the hem of the skirt; and a plurality of buttons attached in a spaced apart relationship from one another on the other of the front and back portions of the hem of the skirt so as to allow fitting of at least some of the buttons through at least some of the button holes and thereby closing of the skirt along the shoulders and arms of the wearer so as to convert the bodice into a mini-skirt and the skirt into blouse.

A new garment includes a tubular bodice having a first open end and a second open end, a skirt having a first open end and a second open end, the skirt being attached at its first open end to the second open end of the tubular bodice, and a plurality of buttons and button holes around at least one of the first open end of the tubular bodice and the second open end of the skirt. The buttons are configured to be inserted through the button holes to close off portions of the end they are on.

The garment may be positioned on a wearer's body, with one or more of the buttons inserted through corresponding button holes to close off a portion of the end they are on, and with the closed off portion is looped over a portion of the wearer's body to prevent the garment or a portion thereof from falling downward. The tubular bodice may be positioned extending over a portion of the wearer's lower body, and the skirt may be positioned above the tubular bodice extending over a portion of the wearer's upper body. The closed off portion may include a shoulder strap, sleeve portion, or neck strap.

These and other aspects, features, and advantages of the present invention will become more readily apparent from the attached drawings and the detailed description of the preferred embodiments, which follow.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. The invention will be more particularly described in conjunction with the following drawings wherein.

Like reference numerals refer to like parts throughout the several views of the drawings.

REFERENCE NUMERALS/PARTS LIST

Figure 1:
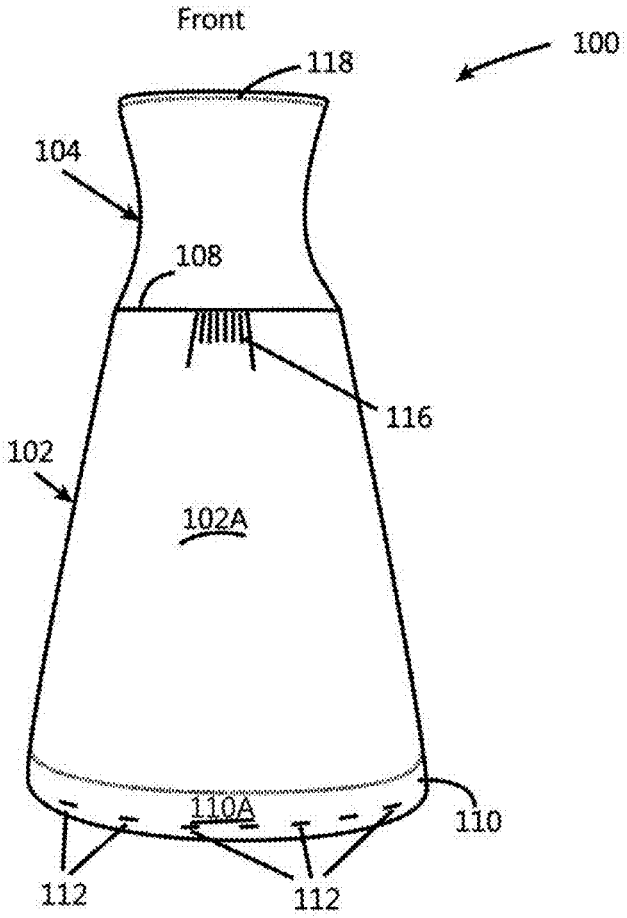
FIGS. 1 and 2 are front and back views respectively of a first embodiment of a composite garment, being presented as a dress.
Figure 2:
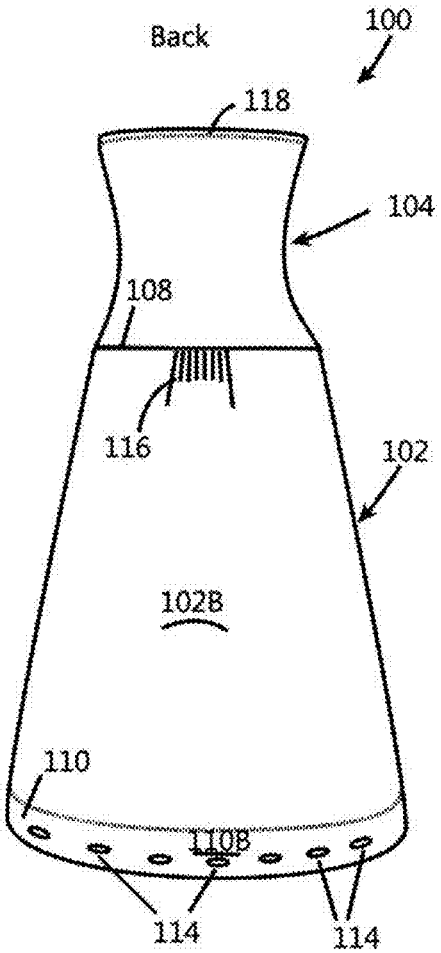
Figure 3:
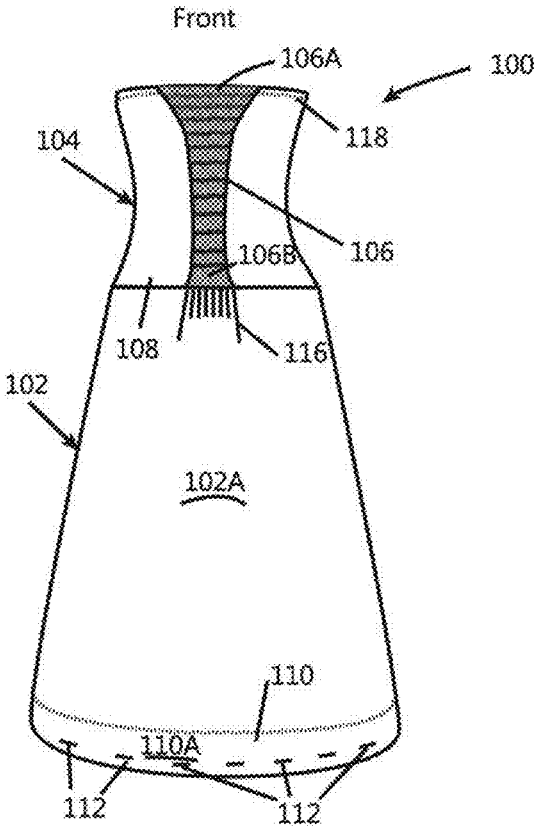
FIGS. 3 and 4 are front and back views respectively of a second embodiment of the composite garment, being presented as a dress.
Figure 4:
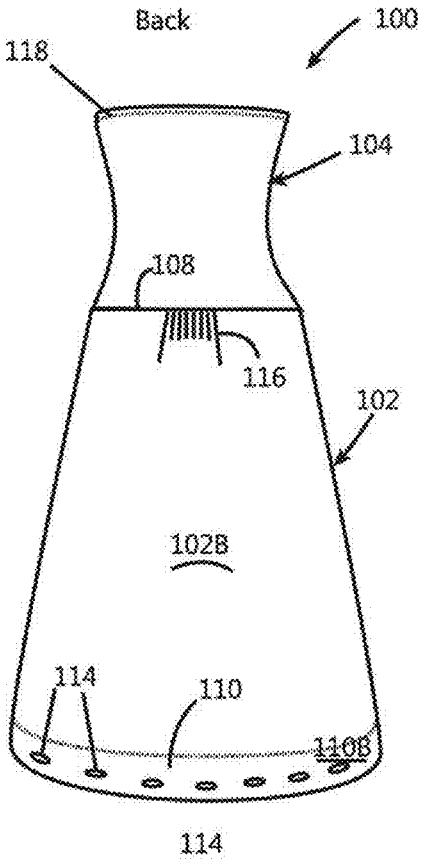
Figure 5:
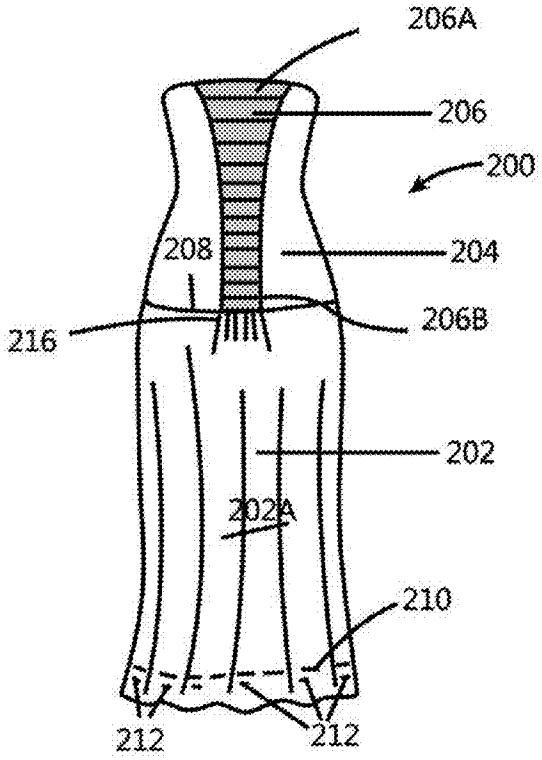
FIGS. 5-7 are front, side (or profile) and back views respectively of a third embodiment of the composite garment, being presented as a dress differently proportioned compared to that of the second embodiment of FIGS. 3 and 4.
Figure 6:
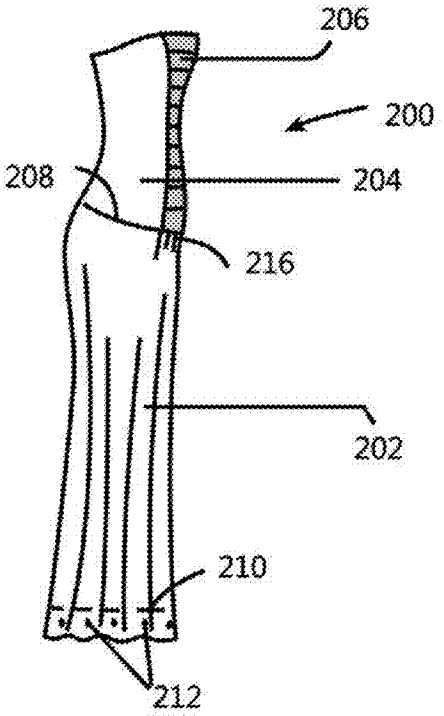
Figure 7:
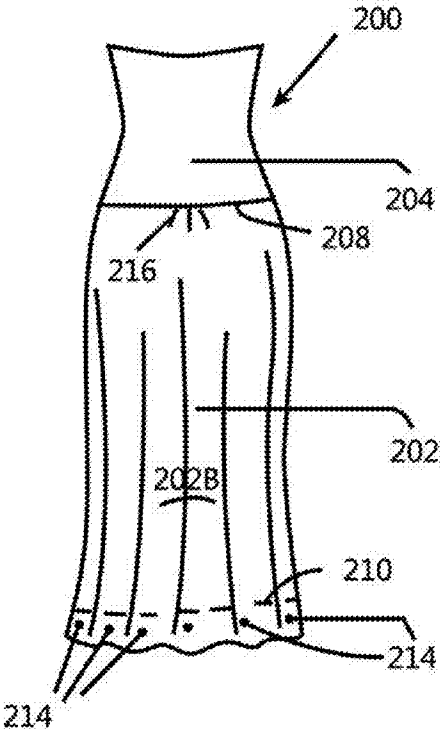
Figure 8:
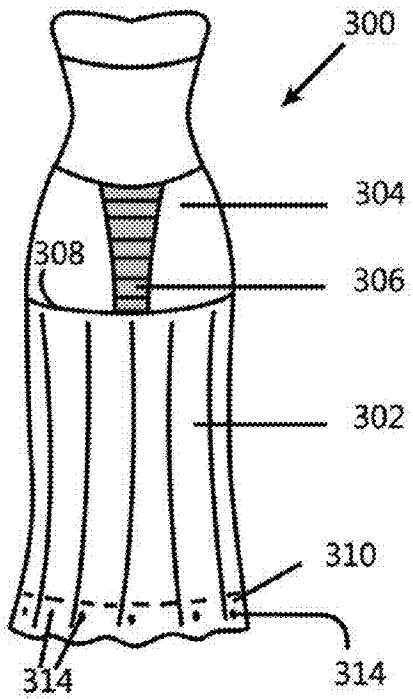
FIGS. 8-10 are front, side (or profile) and back views respectively of a fourth embodiment of the composite garment, being presented as a skirt differently proportioned compared to that of the third embodiment of FIGS. 5-7.
Figure 9:
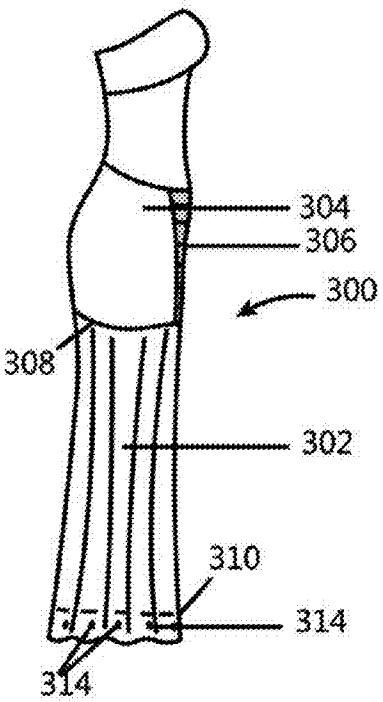
Figure 10:
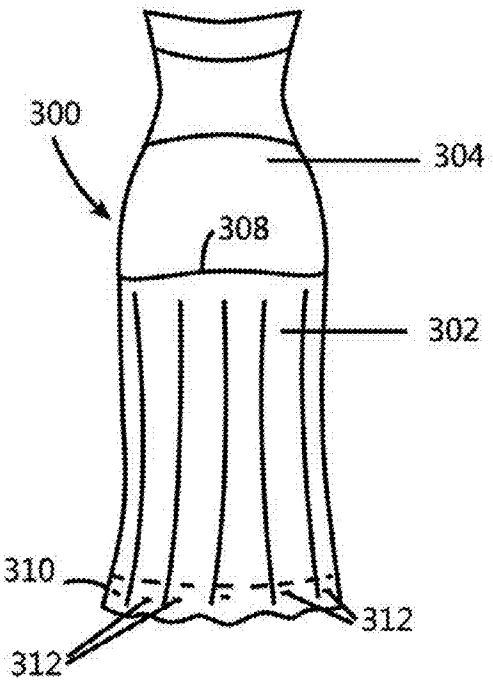

100—composite garment (FIGS. 1-4)
102—skirt of garment 100
  102A—front
  102B—back
104—bodice of garment 100
106—front panel
  106A—first end
  106B—second end
108—middle seam between skirt 102 & bodice 104
110—hem on skirt 102
  110A—front portion
  110B—back portion
112—button holes in hem 110
114—buttons on hem 110
116—ruffled portion of skirt 102
118—elastic band along top edge margin of bodice 104
200—composite garment (FIGS. 5-7)
202—skirt of garment 200
  202A—front
  202B—back
204—bodice of garment 200
206—front panel
208—middle seam between skirt 202 & bodice 204
210—hem on skirt 202
212—button holes in hem 210
214—buttons on hem 210
216—ruffled portion of skirt 202
300—composite garment (FIGS. 8-16)
302—skirt of garment 300
304—bodice of garment 300
306—front panel
308—middle seam between skirt 302 & bodice 304
310—hem on skirt 302
312—button holes in hem 310
314—buttons on hem 310
320—pair of tights

DETAILED DESCRIPTION

A composite garment wearable as a multitude of outfit variations, such as differing embodiments of dresses, skirts, trousers, tops, ponchos and jumpsuits, will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail.

The description is not to be taken in a limiting sense, but is made merely for the purpose of illustrating the general principles of the invention, since the scope of the invention is best defined by the appended claims.

Referring now to FIGS. 1-4, first and second embodiments of a composite garment, generally designated 100, are presented as dresses but are wearable in a multitude of outfit variations being shown in FIG. 17. The composite garment 100 includes a skirt 102 and a tube or bodice 104. It should be understood that the modern definition of the term "bodice" is intended in which the term refers to the part of a woman's dress (excluding sleeves) above the waist (see Concise Oxford English Dictionary, Eleventh Edition, Revised, ISBN 978-0-19-954841-5), with reference to the embodiments of FIGS. 1-4. The coverage of the bodice is extended in length to below the waist in some of the other embodiments. The second embodiment of the composite garment 100 differs from the first embodiment only in that the second embodiment additionally has a panel 106 at a front vertical portion of the bodice 104 that is smocked in an elasticated manner, such as by use of an elasticated thread. The smocked panel 106 may be wider at a first end 106A than at a second end 106B thereof. The bodice 104 may be worn as shown, extending above (or if reversed, below) the skirt 102, or may be worn partially or completely covered by the skirt 102, as in FIGS. 17Y and 17Z. For example, first end 106A may be pulled to the wearer's waist, and then second end 106B may be pulled up and over the first end 106A to the wearer's armpits, so that the second end 106B and top of skirt 102 are now above first end 106A. Similarly, first end 106A may be worn at the wearer's midriff and second end 106B at the wearer's waist with a portion of bodice 104 tucked under second end 106B so that the bodice 104 is partially covered by skirt 102.

The skirt 102 is formed by a loose piece of material of a bell-shaped longitudinal configuration. The bodice 104 is formed by a tubular-shaped piece of material of an hourglass longitudinal configuration. An endless middle seam 108 joins the bodice 104 with the skirt 102. The skirt 102 has an endless bottom hem 110 with front and back portions 110A, 110B and made of reinforced fabric. A plurality of button holes 112 are formed in a spaced apart relationship from one another in the front portion 110A of the bottom hem 110. A plurality of buttons 114 are attached in a similar spaced apart relationship from one another on the back portion 110B of the bottom hem 110. Buttons 114 may be attached to the inside and/or outside of the bottom hem 110. If attached to the outside, they are visible when unbuttoned, and a portion of the hem with a button on it must be folded inside the skirt 102, or a portion of the front hem portion 110A with a button hole 112 on it must be folded over the button 114, in order for the button 114 to be inserted through the button hole 112.

In various embodiments, features of the garment provide for the ability to wear it as any number of different types of outfits. The tubular bodice is elasticated at the upper section and lower seam to allow stretch through different outfits. The smocked panel of elasticated woven fabric may expand to double the size when stretched to allow the tubular bodice to fit snugly but not constrictively over all parts of the body, such as bust, waist, hips, etc. The bell shaped skirt has a width and length that allows it to work as a skirt, dress, trouser, top or poncho. The buttons on the skirt hem increase the number of possible outfits dramatically, both when the skirt is worn as a lower body covering, to close the skirt between the legs to make trousers or a jumpsuit and when the skirt is worn as a top by creating a wide variety of different head holes, arm holes and sleeves, back openings, etc.

Referring to FIGS. 5-7 and 8-10, the composite garments 200, 300 of the third and fourth embodiments respectively include skirts 202, 302 and bodices 204, 304, being differently proportioned compared to one another and also to the skirt 102 and bodice 104 composite garment 100 of FIGS. 1-4. These embodiments may be garments produced with different proportions, or may be the same garment as in FIGS. 1-4 with the bodice folded over to create the different proportions/appearance. Like the composite garment 100, the composite garments 200, 300 also have respective front vertical panels 206, 306, middle seams 208, 308, bottom hems 210, 310, button holes 212, 312 and buttons 214, 314. Also, the composite garments 200, 300 are presented as dresses but are wearable in a multitude of outfit variations being shown in FIG. 17.

Figure 19:
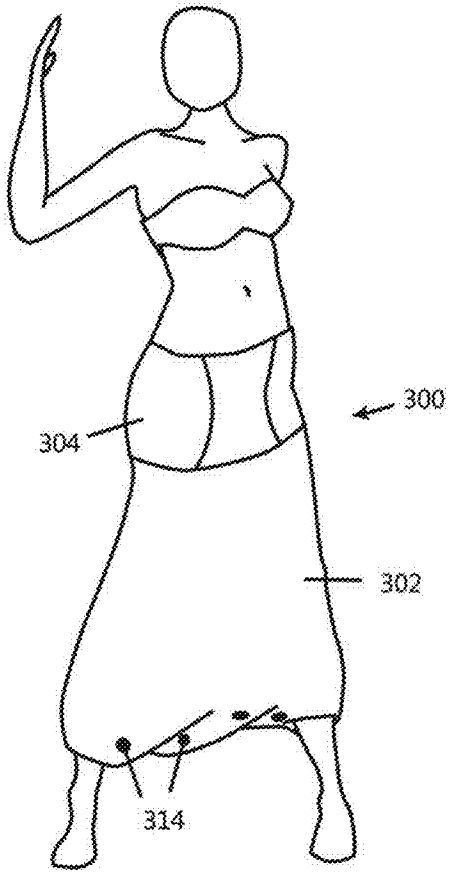
Figure 25:
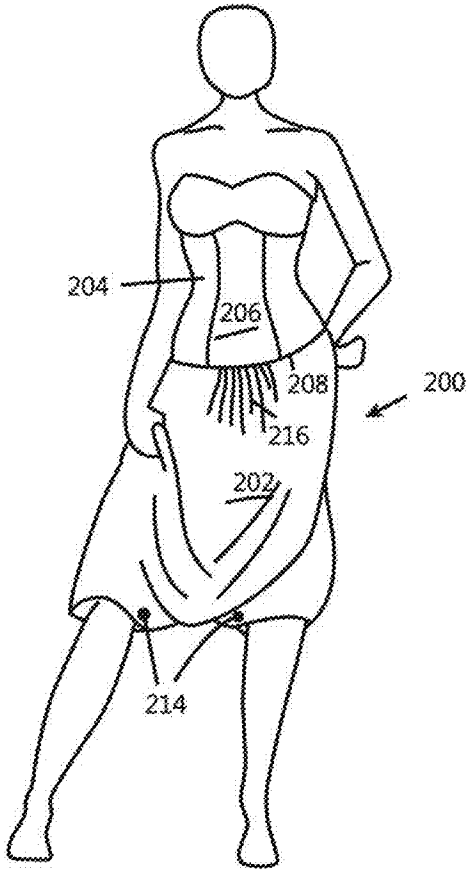

As seen in FIGS. 1-10, the skirts 102, 202, 302 of the respective garments 100, 200, 300 fit around the wearer's body downward from proximate the waist or the hips to proximate the knees of the wearer. The bodices 104, 204, 304 of the respective garments 100, 200, 300 fit around the wearer's body upward from the proximate the waist or the hips to proximate the arm pits of the wearer. As seen in FIGS. 25 and 19, at least some of the buttons 214, 314 may be fitted through at least some of the button holes 212, 312 so as to close the skirt 202, 302 at its bottom hem 210, 310 between the wearer's legs so as to convert the skirt 202, 302 into a pair of trousers, being of either above or below knee-length.

Also, as shown in FIGS. 1-7, the skirts 102, 202 may have respective endless top edge margins containing respective ruffled portions 116, 216 proximate the middle of the front 102A, 202A and back 102B, 202B of the skirt. Further, as representatively shown in FIGS. 1-4, the bodice 104 of the garment 100 may have an endless top edge margin with a band 118 of elastic material attached, such as by way of example but not limitation being sewn with chain stitch, along the top edge margin so as to fit the bodice 104 about the upper back and across the front bust of the wearer, as shown in the exemplary outfits in FIG. 24-26. The tubular-shaped piece of material forming the bodices 104, 204, 304 may be elastic at least at top and bottom portions so as to allow stretching and clinging of the bodice around regions of the wearer's body above and below the waist of the wearer, as shown in FIGS. 5-10, 25 and 26.

As shown in FIGS. 1-16, the bodices 104, 204, 304 also have open opposite ends located proximate to and remote from the respective skirts 102, 202, 302. The respective positions of the open opposite ends of the bodices, being spaced above and below one another, are reversible such that the respective bodices are configured to be worn in either one of an upright orientation, as shown in FIGS. 1-10, or an inverted orientation, as shown in FIGS. 11-16, so as to place the skirts 102, 202, 302 on the wearer in either one of below or above the bodices 104, 204, 304.

Figure 11:
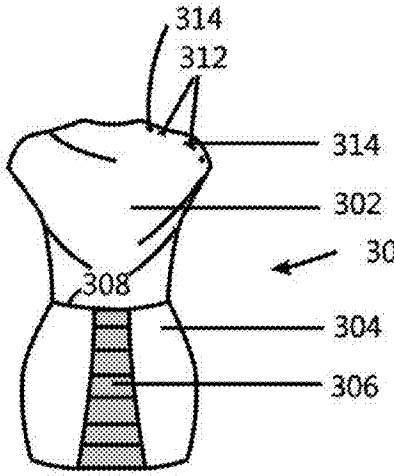
FIGS. 11-13 are front, side (or profile) and back views respectively of a fifth embodiment of the composite garment, being presented as mini-dresses.
Figure 12:
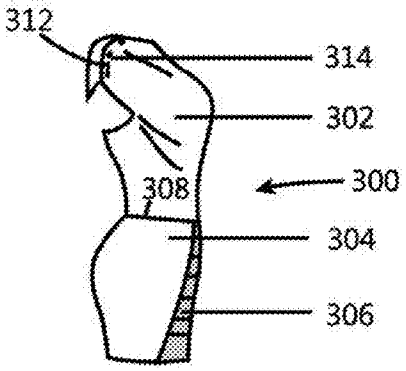
Figure 13:
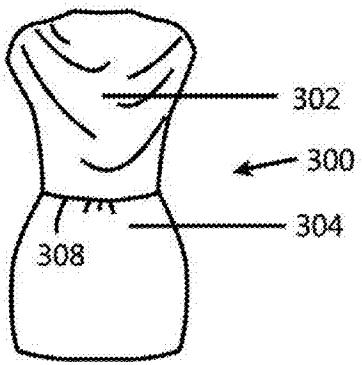
Figure 16:
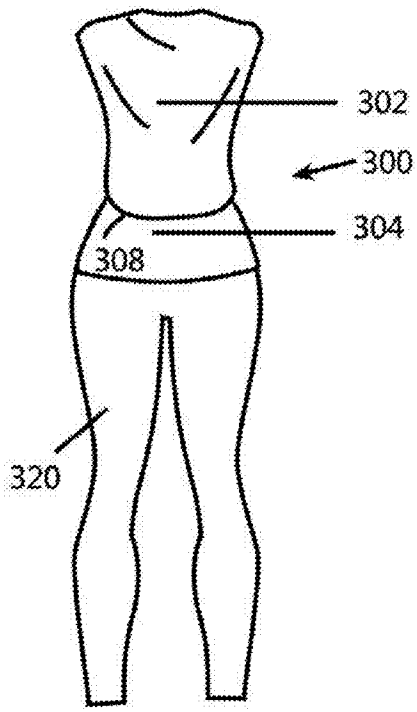
FIGS. 14-16 are front, side (or profile) and back views respectively of a sixth embodiment of the composite garment, being presented as tops differently proportioned compared to that of the fifth embodiment of FIGS. 11-13 in combination with tights.
Figure 15:
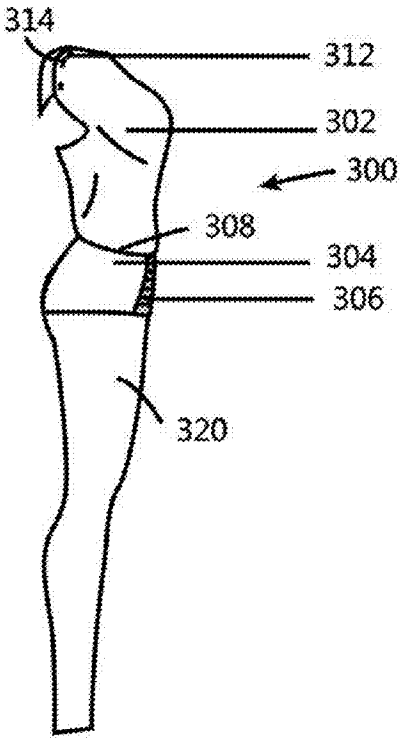
Figure 14:
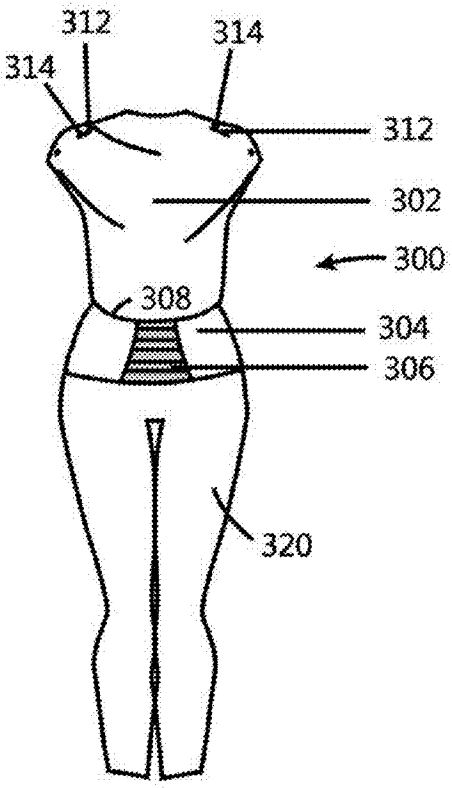

In FIGS. 11-13, the composite garment 300 is worn in the inverted orientation so that its bodice 304 fits around the wearer's body from above the waist downward to below the hips of the wearer and its skirt 302 fits around the wearer's body from the bodice 304 upward to the wearer's shoulders. The hem 310 is now located at the wearer's shoulders with at least some of the buttons 314 fitted through at least some of the button holes 312 so as to thereby close the skirt 302 along the wearer's shoulders and arms so as to convert the bodice 304 and skirt 302 into the combination of a mini-skirt and a top or blouse. In FIGS. 14-16, the composite garment 300 is worn in the same manner as in FIGS. 11-13, except the bodice 304 is further folded to shorten the length of the "mini-skirt" and now a pair of tights 320 are worn from the wearer's waist under the mini-skirt downward covering the wearer's legs.

Figure 17A:
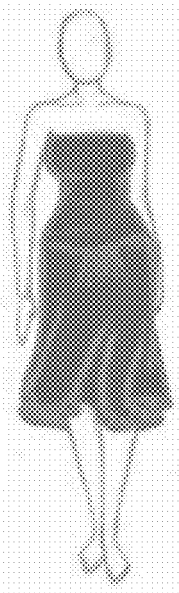
FIGS. 17A-17AZ depict the composite garment wearable in a multitude of outfit variations, such as differing embodiments of dresses, skirts, trousers, tops, ponchos and jumpsuits.
Figure 17B:
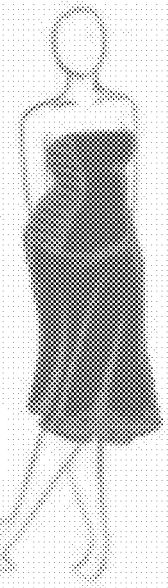

In FIGS. 17A-17AZ the above-described embodiments of the composite garments are shown wearable in a multitude of outfit variations, such as differing embodiments of dresses, skirts, trousers, tops, ponchos and jumpsuits. FIGS. 18-29 show respective enlarged front and back views of selected ones of the exemplary outfit variations of the composite garments 200, 300 in FIGS. 17A-17AZ.

Figure 20:
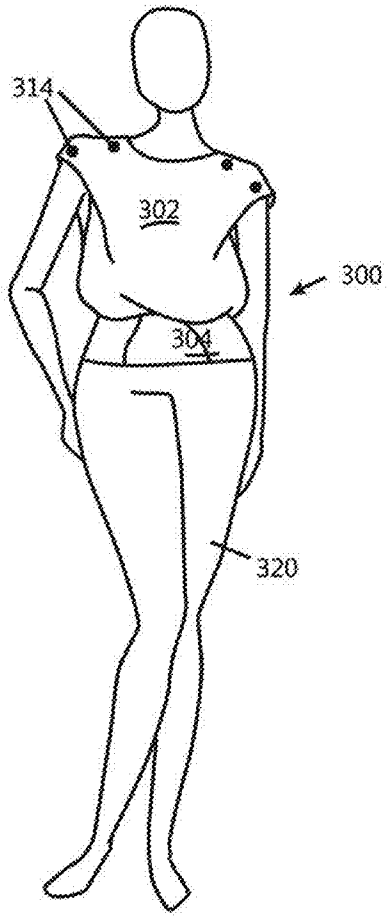
FIGS. 18-20 are enlarged front views of exemplary outfit variations of the composite garment as shown in FIGS. 17AI, 17O and 17AM, respectively.
Figure 18:
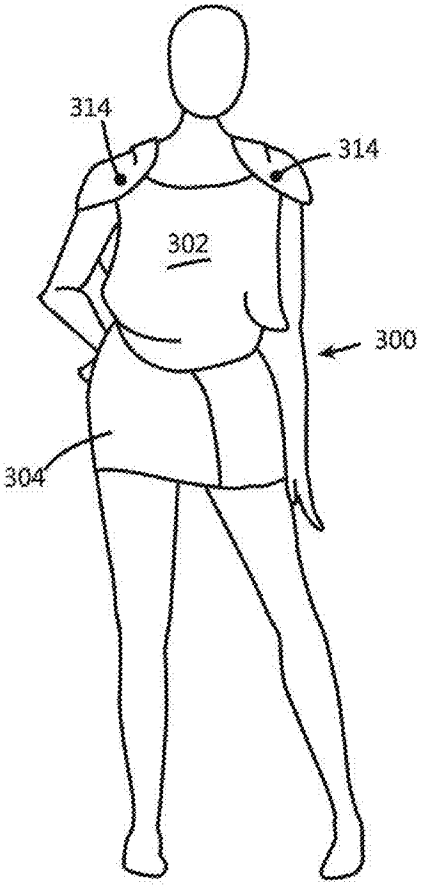

FIGS. 18-20 are enlarged front views of exemplary outfit variations of the composite garment as shown in FIGS. 17AI, 17O and 17AM, respectively. FIG. 18 shows the garment worn as a dress, with two buttons 314 inserted through button holes 312 on both shoulders and the rest left unbuttoned, creating a head hole between the two buttons and arm holes on either side. FIG. 19 shows the garment worn as a pair of trousers, with four buttons 314 inserted through button holes 312 to close off the bottom opening of the bell-shaped skirt 302 except for leg openings on either side. FIG. 20 shows the garment worn as a shirt, with two sets of adjacent buttons inserted through button holes to create a head hole between the two sets and arm holes to either side. The garment in FIG. 20 may be in a front/back reversed position from FIG. 18, such that the overlaps lines visible in the front near the buttons in FIG. 18 are not visible in FIG. 20.

Figure 21:
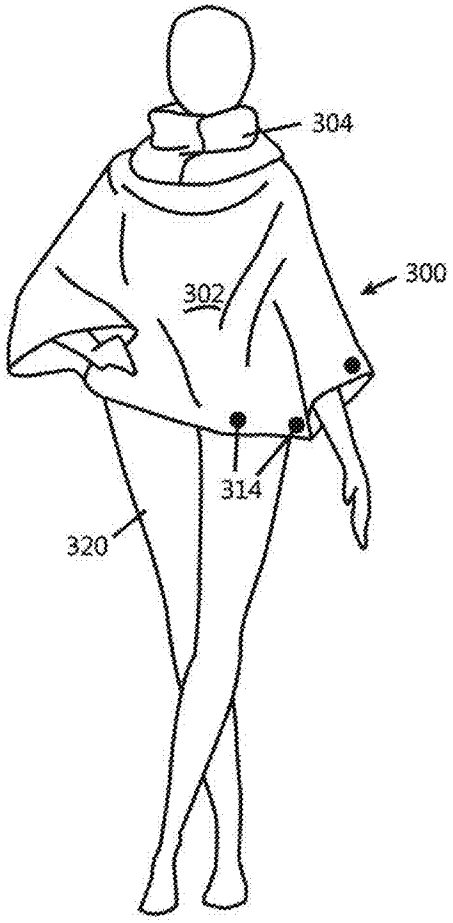
FIGS. 21-23 are enlarged front views of exemplary outfit variations of the composite garment as shown in FIGS. 17AY, 17AM and 17AQ, respectively.
Figure 22:
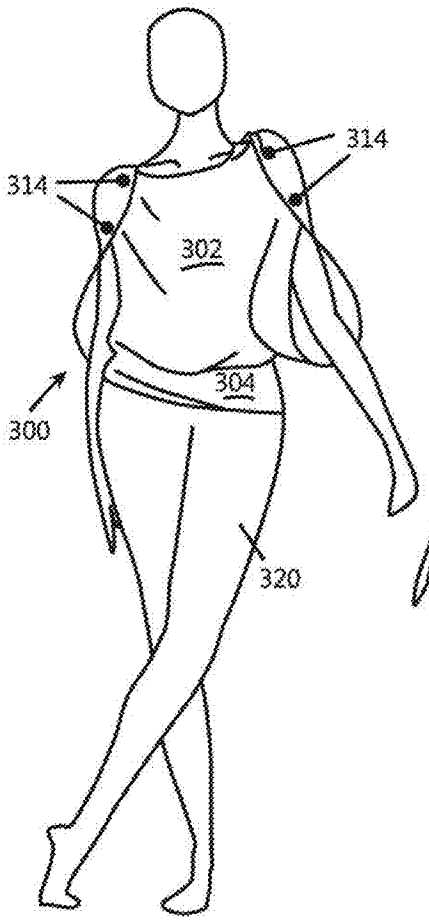
Figure 23:
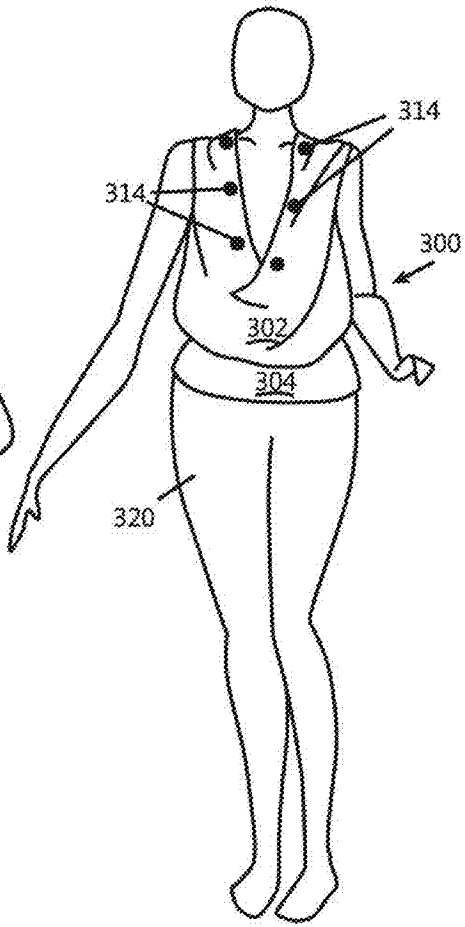

FIGS. 21-23 are enlarged front views of exemplary outfit variations of the composite garment as shown in FIGS. 17AY, 17AM and 17AQ, respectively. FIG. 21 shows the garment worn as a poncho, with one button 314 inserted through a button hole 312 on each side of the opening of the skirt 302 to create arm holes on either side and a central hole between the two buttons 314 for the wearer's hips to pass through. Here, bodice 304 is worn around the neck. FIG. 22 shows the garment worn as a top, similar to in FIG. 18, however here adjacent sets of two buttons 314 on each side are inserted through button holes 312 to create the distinct head and arm holes. FIG. 23 shows the garment worn as a top, where one button 314 is inserted through a button hole 312 behind the wearer's neck, dividing the skirt 302 opening into two portions, a head hole through which the wearer's head extends and a back opening through which the wearer's arms extend and a portion of their back shows. There are no sleeves in this configuration.

Figure 17C:
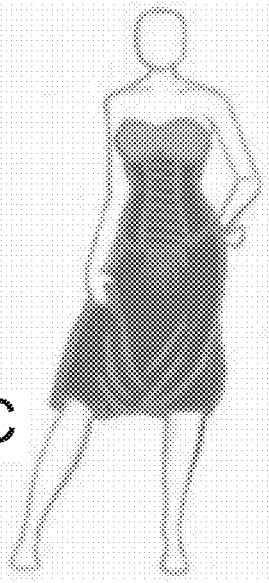
Figure 17D:
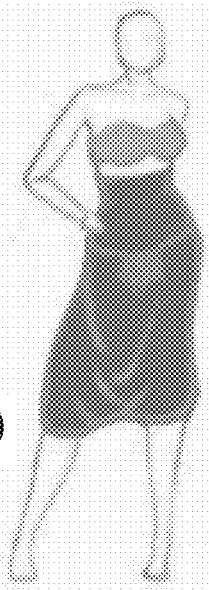
Figure 17E:
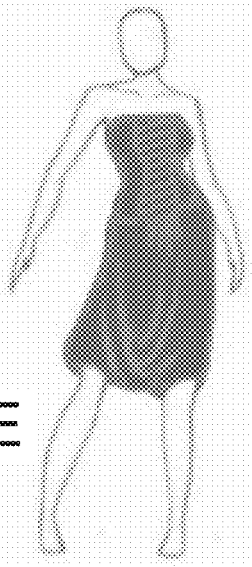
Figure 17F:
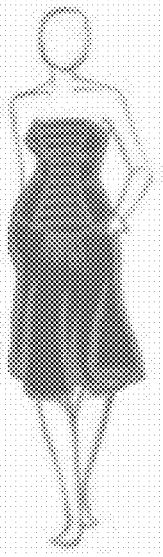
Figure 17G:
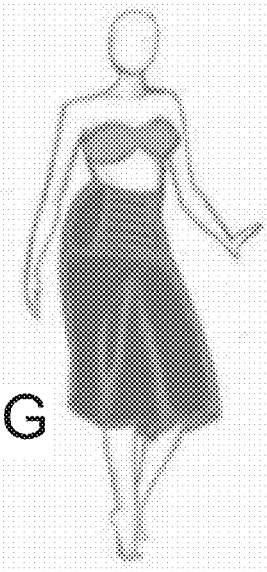
Figure 17H:
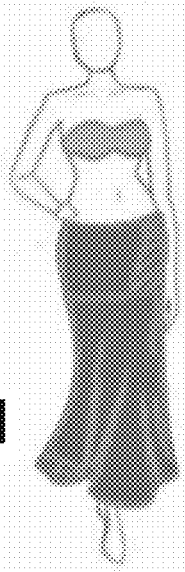
Figure 17I:
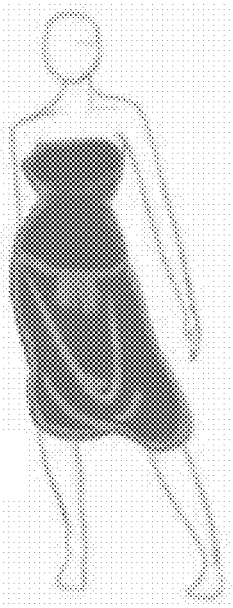
Figure 17J:
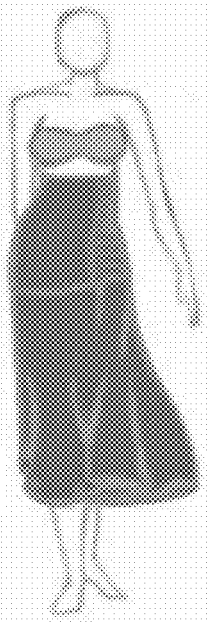
Figure 17K:
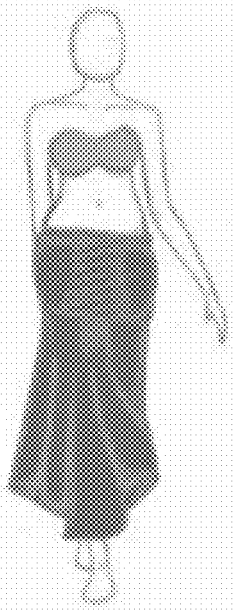
Figure 17L:
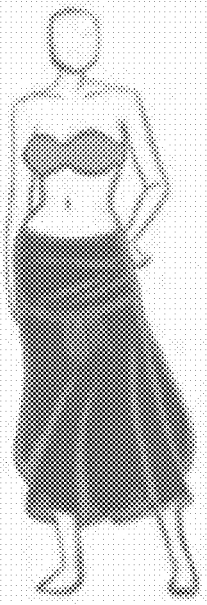
Figure 17M:
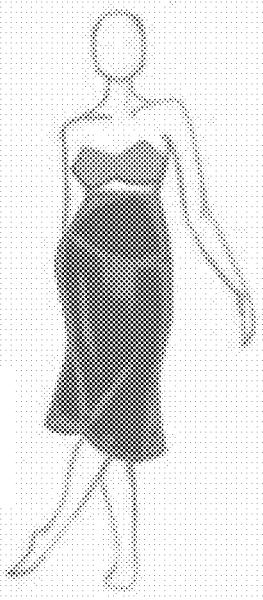
Figure 17N:
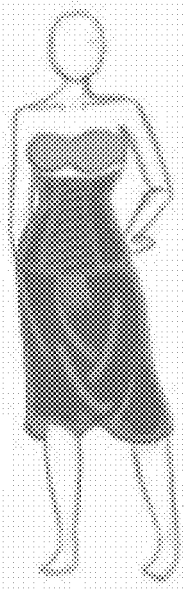
Figure 17O:
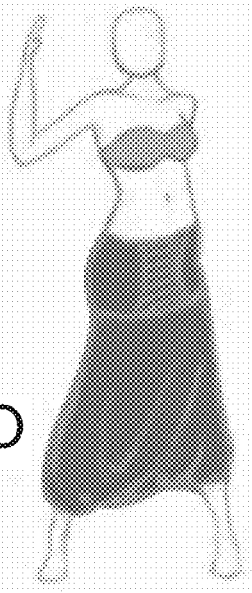
Figure 17P:
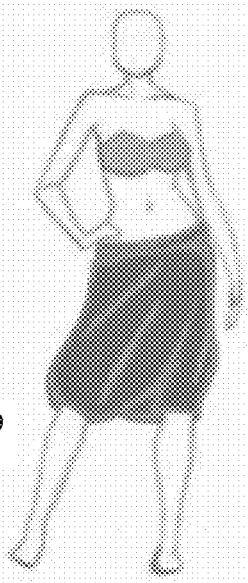
Figure 17Q:
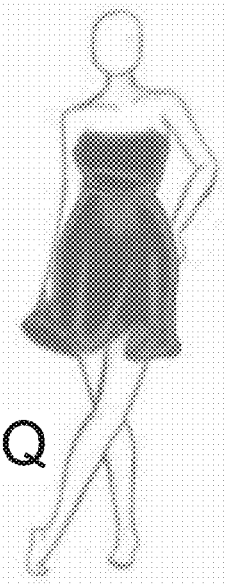
Figure 17R:
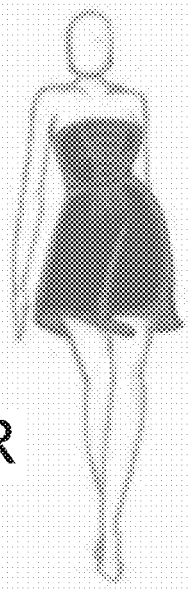
Figure 17S:
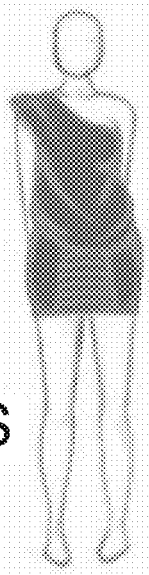
Figure 17T:
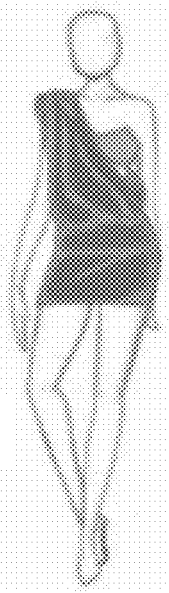
Figure 17U:
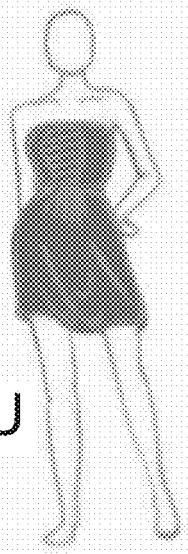
Figure 17V:
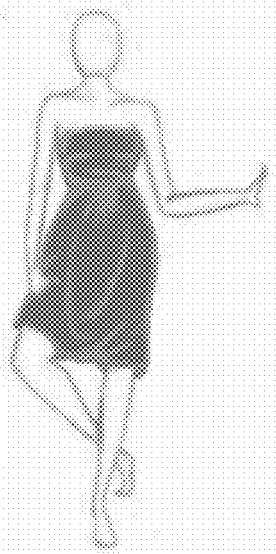
Figure 17W:
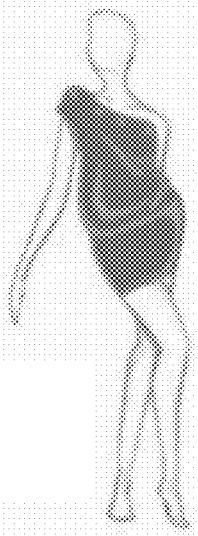
Figure 17X:
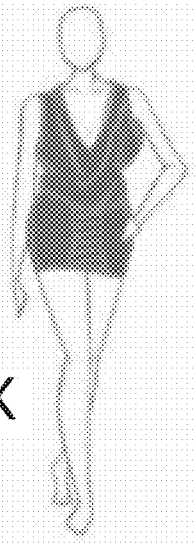
Figure 17Y:
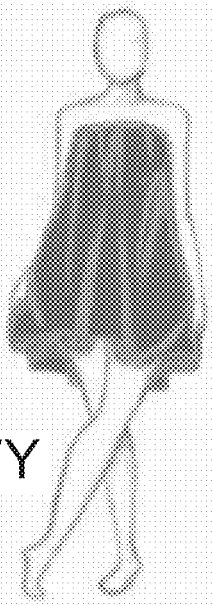
Figure 17Z:
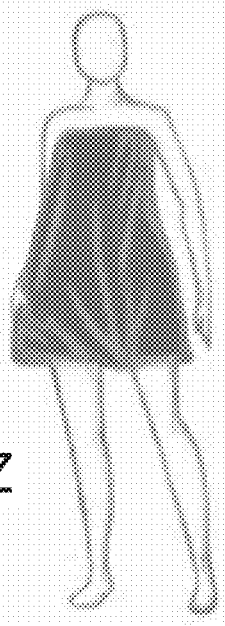
Figure 17A:
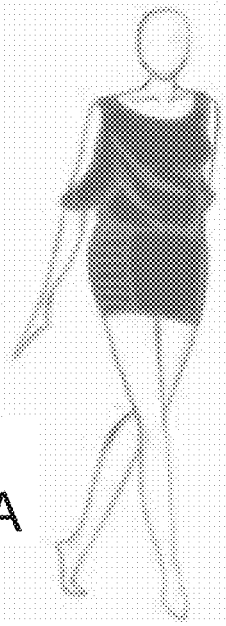
Figure 17A:
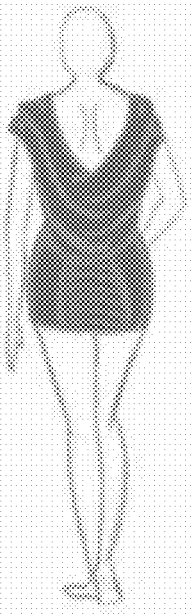
Figure 17A:
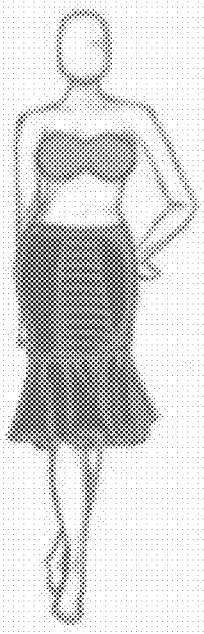
Figure 17A:
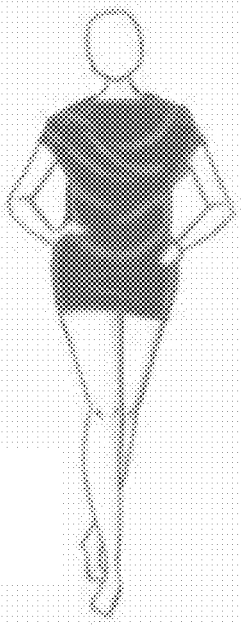
Figure 17A:
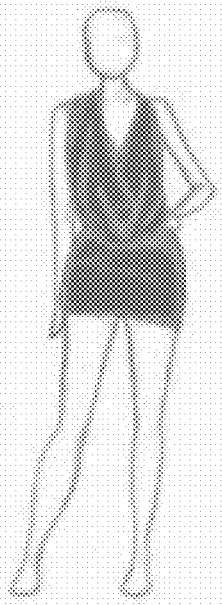
Figure 17A:
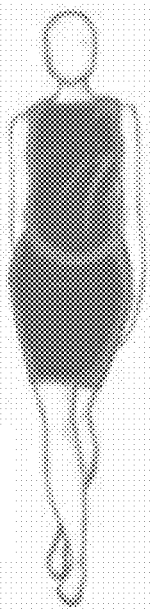
Figure 17A:
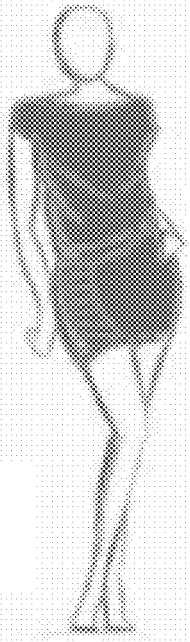
Figure 17A:
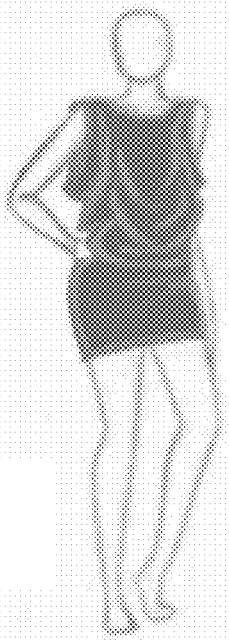
Figure 17A:
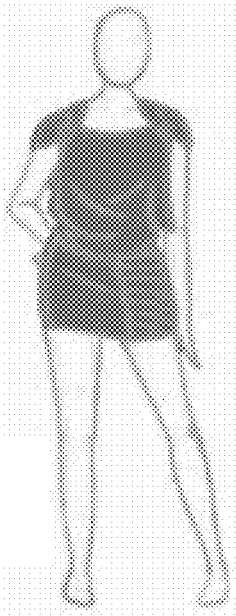
Figure 17A:
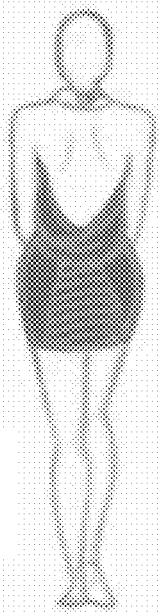
Figure 17A:
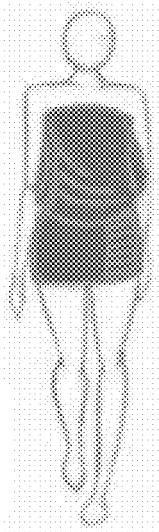
Figure 17A:
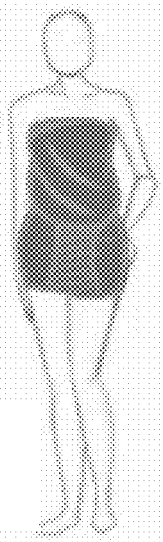
Figure 17A:
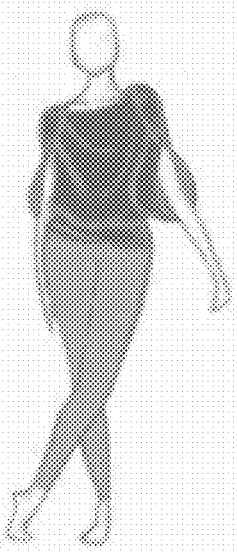
Figure 17A:
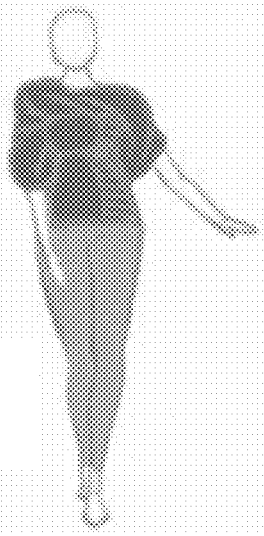
Figure 17A:
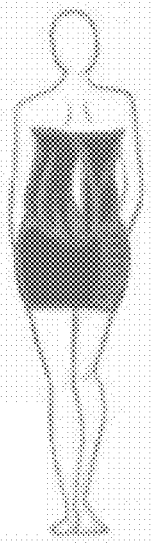
Figure 17A:
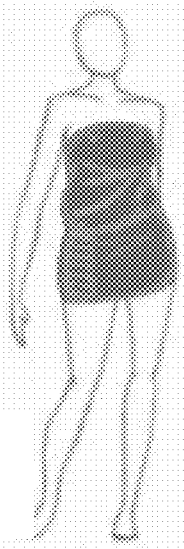
Figure 17A:
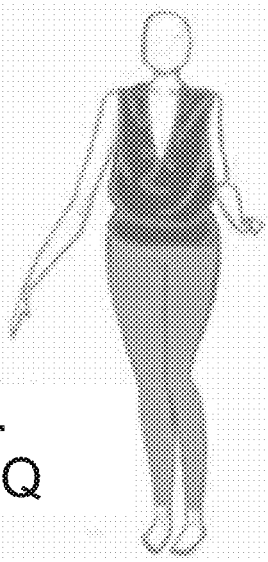
Figure 17A:
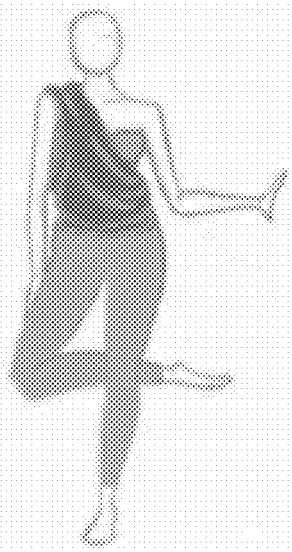
Figure 17A:
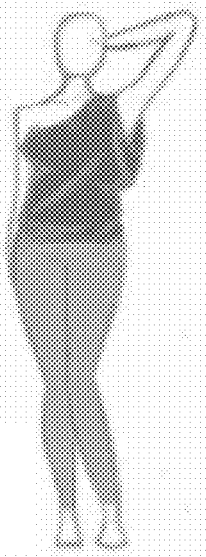
Figure 17A:
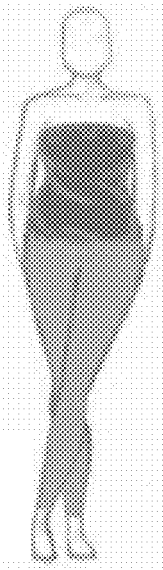
Figure 17A:
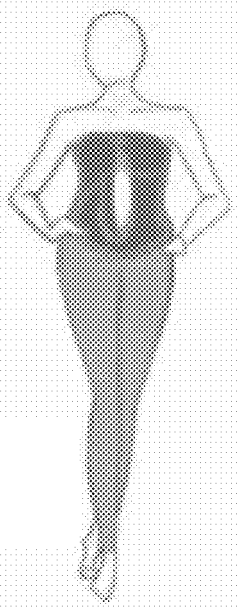
Figure 17A:
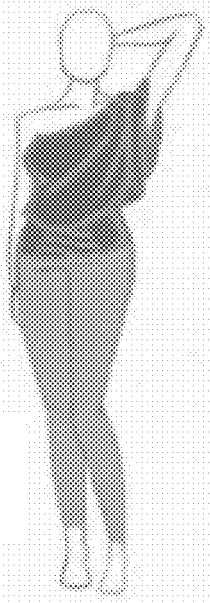
Figure 17A:
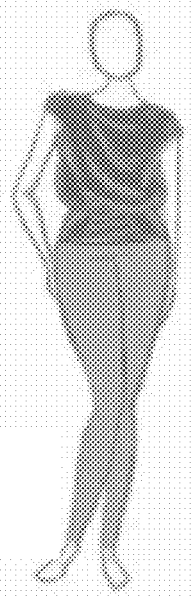
Figure 17A:
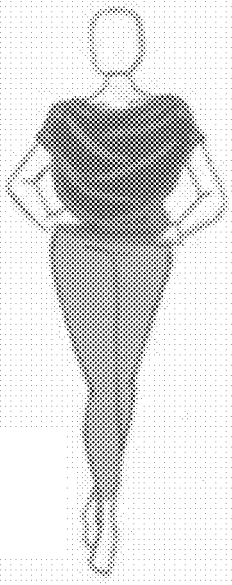
Figure 17A:
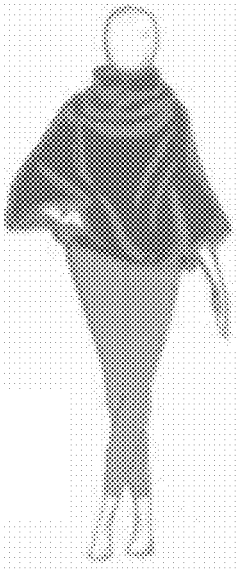
Figure 17A:
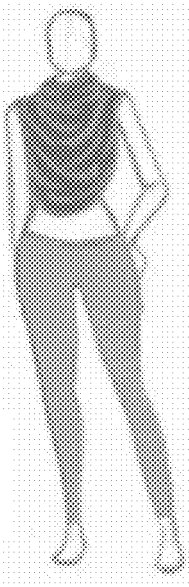
Figure 26:
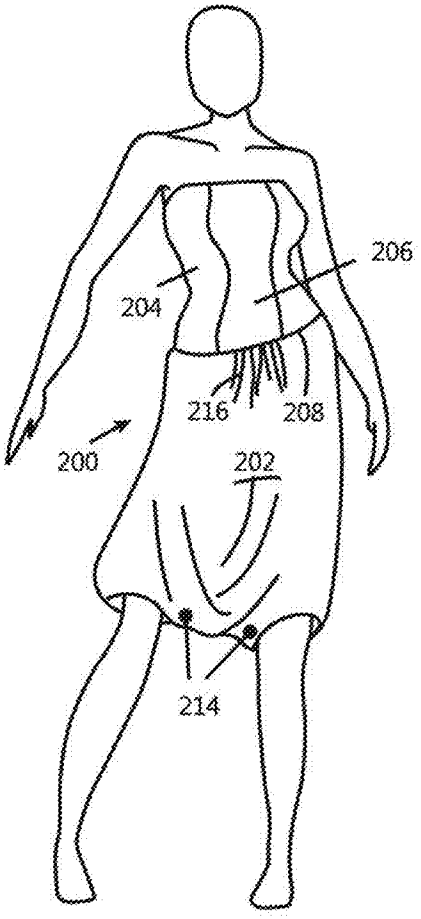
FIGS. 24-26 are enlarged front views of exemplary outfit variations of the composite garment as shown in FIGS. 17K, 17C and 17E, respectively.
Figure 24:
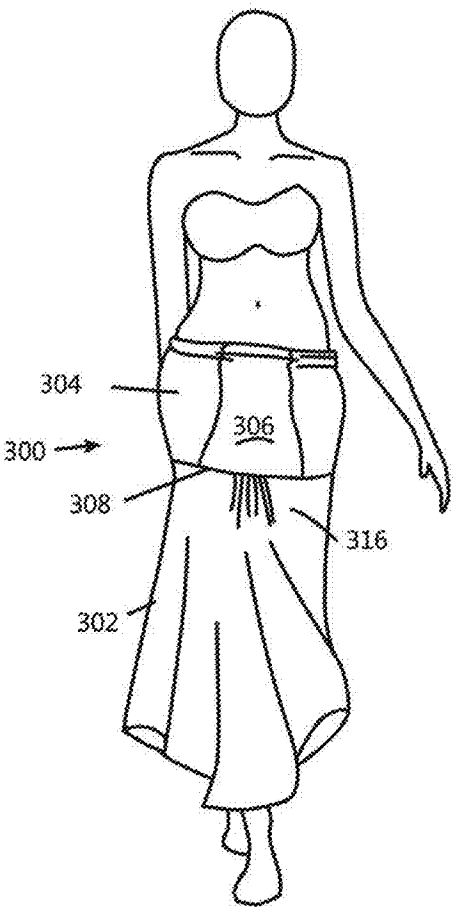

FIGS. 24-26 are enlarged front views of exemplary outfit variations of the composite garment as shown in FIGS. 17K, 17C and 17E, respectively. FIG. 24 shows the garment worn as a skirt, with bodice 304 around the hips and skirt 302 extending downward therefrom. FIG. 25 shows the garment worn as high waisted short trousers with buttons 214 inserted through button holes to form legs and bodice 204 covering the wearer's waist and torso up to the bust. FIG. 26 shows the garment worn as a dress or jumpsuit, but with trousers instead of a skirt portion, buttons 214 being inserted through button holes to form the leg holes of the trousers and bodice 204 extending up and over the wearer's bust.

Figure 29:
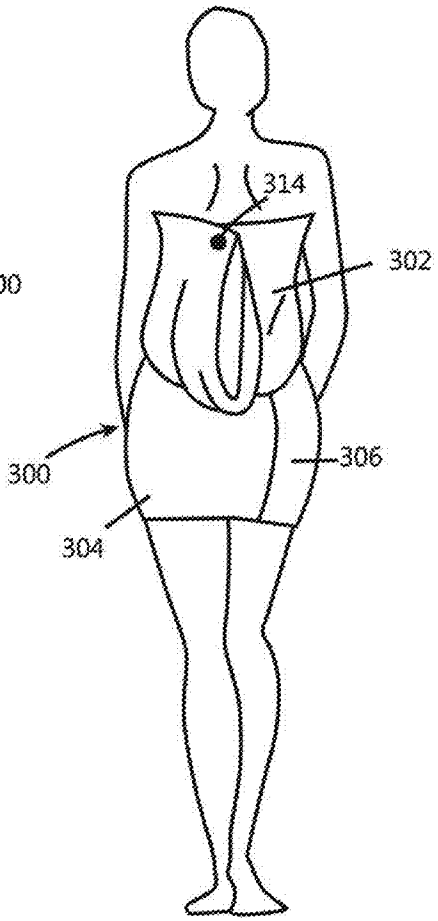
FIGS. 27-29 are enlarged back views of exemplary outfit variations of the composite garment as shown in FIGS. 17AB, 17AJ and 17AO, respectively.
Figure 28:
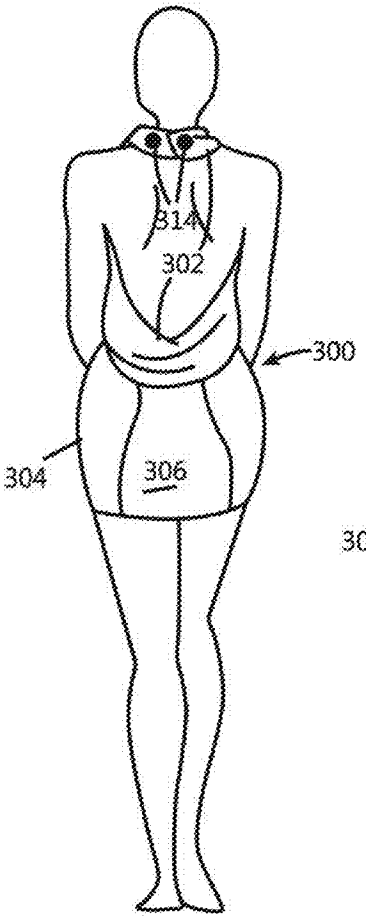
Figure 27:
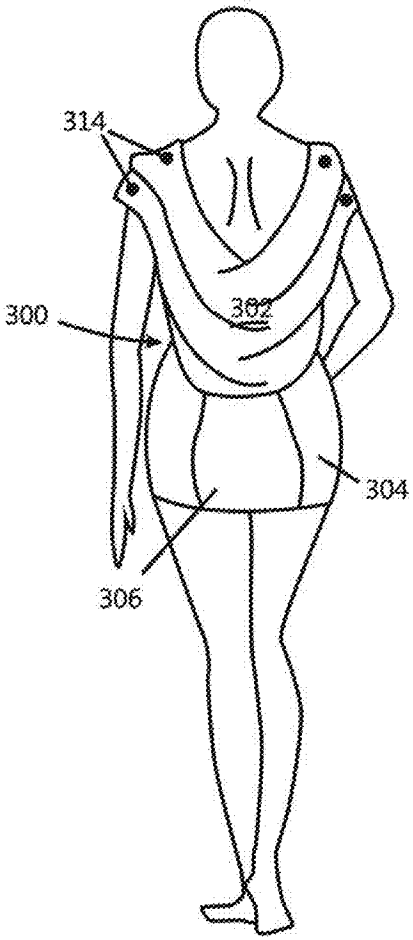

FIGS. 27-29 are enlarged back views of exemplary outfit variations of the composite garment as shown in FIGS. 17AB, 17AJ and 17AO, respectively. FIG. 27 shows the garment worn as a mini-dress, with bodice 304 fitted over the wearer's hips and two sets of adjacent buttons 314 inserted through button holes 312 to form central head opening and side sleeves. FIG. 28 shows the garment worn as a mini-dress, with bodice 304 fitted over the wearer's hips and a button 314 inserted through a button hole 312 behind the wearer's neck to form a head hole and back opening through which the wearer's arms extend. FIG. 29 shows the garment worn as a dress, with bodice 304 fitted over the wearer's hips and a button 314 inserted through a button hole 312 behind the wearer's back to form a top opening through which the wearer's head and shoulders extend and back opening through which the wearer's back is partially exposed.

By way of example but not limitation with respect to the various embodiments of the composite garments: the skirts may be 60 cm. in length; the bodices may be 38 cm. in length; the material of the bodice and skirt may be a fabric made from jersey/elastane (95%/5%) or 100% cotton or other jersey fabrics; the pluralities of button holes and buttons in the bottom hem of the skirts may each be seven in number; the smocked panel on the bodices may be 33 cm. at the first end and 15 cm. at the second end; and the smocked panel may be in the form of a suitable conventional woven fabric. These dimensions and materials allow the garment to be worn in the variety of configurations described above, with the sizing intended to provide adequate body coverage for a wide range of women, with flexibility provided by the elastic portions and ability to create openings of various sizes using different button arrangements. The composite garments can be provided in many colors and prints.

The invention is not limited to the particular embodiments illustrated in the drawings and described above in detail. Those skilled in the art will recognize that other arrangements could be devised. The invention encompasses every possible combination of the various features of each embodiment disclosed. While the invention has been described with reference to specific illustrative embodiments, modifications and variations of the invention may be constructed without departing from the spirit and scope of the invention as set forth in the following claims.

What is claimed is:

1. A composite garment wearable in a multitude of outfit variations, comprising:

a single garment, including a bodice and skirt, that is reconfigurable with the use of buttons to form trousers, skirt, dress and blouse;

the skirt being formed by a loose piece of material of a bell-shaped longitudinal configuration that fits around a body of a wearer downward from proximate the waist to proximate the knees of the wearer, said skirt having a bottom hem with front and back portions;

wherein the skirt can also be inverted so the bottom hem is worn at the shoulders as a blouse;

the bodice being formed by a tubular-shaped piece of material of an hour-glass longitudinal configuration that fits around the body of the wearer upward from proximate the waist to proximate the arm pits of the wearer;

wherein the bodice can be inverted so the upper hem is worn on the thighs and becomes a figure hugging skirt portion;

a seam joining said bodice with said skirt;

a plurality of button holes formed in a spaced apart relationship from one another in one of said front and back portions of said bottom hem of said skirt; and a plurality of buttons attached in a spaced apart relationship from one another on the other of said front and back portions of said bottom hem of said skirt so as to allow fitting of at least some of said buttons through at least some of said button holes and thereby closing of said skirt at said bottom hem thereof between the legs of the wearer so as to reconfigure and convert said skirt into a pair of trousers of either above or below knee-length;

wherein when the skirt is inverted, the buttons can be closed to form the blouse as a two-sleeve blouse, a one-sleeve blouse, a sleeveless blouse, or a halter neck blouse.

2. The composite garment of claim 1 wherein said skirt has a top edge margin and ruffled portions proximate said top edge margin at a middle of a front and a back of the skirt.

3. The composite garment of claim 1 wherein said bodice has a top edge margin and a band of elastic material attached along said top edge margin of said bodice so as to allow stretching and clinging of said bodice about the upper back and across the front bust of the wearer.

4. The composite garment of claim 1 wherein at least top and bottom portions of said tubular-shaped piece of material forming said bodice is elastic so as to allow stretching and clinging of said bodice around regions of the body of the wearer and reconfiguring to wear either above or below the waist of the wearer.

5. The composite garment of claim 1 wherein said bodice has open opposite ends located proximate to and remote from said skirt whose positions are spaced above and below one another and are reconfigured and inverted such that said bodice is configured to be worn in either one of an upright or inverted orientation so as to correspondingly reconfigure said skirt on the wearer to either one of below or above said bodice.

6. The composite garment of claim 1 wherein a front vertical portion of said bodice is smocked in an elasticated manner.

7. The composite garment of claim 6 wherein said smocked front vertical portion of said bodice is wider at a first end than at a second end thereof.

8. A composite garment wearable in a multitude of outfit variations, comprising:

a single garment including a reconfigurable upper portion forming a bodice and a reconfigurable lower portion forming a skirt;

the bodice being formed by a tubular-shaped piece of material of an hour-glass longitudinal configuration that fits around a body of a wearer upward from proximate the waist to proximate the arm pits of the wearer, at least a portion of said tubular-shaped piece of material forming said bodice being elasticated so as to allow stretching and clinging of said bodice around regions of the body of the wearer above and below the waist of the wearer, wherein the bodice can be inverted so the upper hem is worn on the thighs and is a figure hugging skirt portion;

the skirt being formed by a loose piece of material of a bell-shaped longitudinal configuration that fits around the body of the wearer downward from said bodice to below the knees of the wearer, said skirt having a bottom hem with front and back portions, wherein the skirt can also be inverted so the bottom hem is worn at the shoulders as a blouse;

a seam joining said bodice with said skirt;

a plurality of button holes formed in a spaced apart relationship from one another in one of said front and back portions of said bottom hem of said skirt; and a plurality of buttons attached in a spaced apart relationship from one another on the other of said front and back portions of said bottom hem of said skirt so as to allow fitting of at least some of said buttons through at least some of said button holes and thereby closing of said skirt at said bottom hem thereof between the legs of the wearer so as to reconfigure and convert said skirt into a pair of trousers of below knee-length.

9. The composite garment of claim 8 wherein said skirt has a top edge margin and ruffled portions proximate said top edge margin at a middle of a front and a back of the skirt.

10. The composite garment of claim 8 wherein said bodice has a top edge margin and a band of elastic material attached along said top edge margin of said bodice so as to allow stretching and clinging of said bodice about the lower back and across the mid-section of the wearer.

11. The composite garment of claim 8 wherein at least top and bottom portions of said tubular-shaped piece of material forming said bodice is elastic so as to allow stretching and clinging of said bodice around regions of the body of the wearer and reconfiguring to wear either above or below the waist of the wearer.

12. The composite garment of claim 8 wherein said bodice has open opposite ends located proximate to and remote from said skirt whose positions that are spaced above and below one another are reconfigured and inverted such that said bodice is configured to be worn in either one of an upright or inverted orientation so as to correspondingly reconfigure said skirt on the wearer either below or above the bodice.

13. The composite garment of claim 8 wherein a front vertical portion of said bodice is smocked with an elasticated manner.

14. The composite garment of claim 8 wherein said smocked front vertical portion of said bodice is wider at a first end than at a second end thereof.

15. A composite garment wearable in a multitude of outfit variations, comprising:

a single garment including a reconfigurable upper portion forming a bodice and a reconfigurable lower portion forming a skirt;

the bodice bring formed by a tubular-shaped piece of material of an hour-glass longitudinal configuration that fits around a body of a wearer downward from above the waist of the wearer to below the hips of the wearer so as to form a skirt portion;

the skirt bring formed by a loose piece of material of a bell-shaped longitudinal configuration that fits around the body of the wearer upward from said bodice to proximate the shoulders of the wearer, said skirt having a hem at the shoulders of the wearer with front and back portions;

a seam joining said bodice with said skirt;

a plurality of button holes formed in a spaced apart relationship from one another in one of said front and back portions of said hem of said skirt; and a plurality of buttons attached in a spaced apart relationship from one another on the other of said front and back portions of said hem of said skirt so as to allow fitting of at least some of said buttons through at least some of said button holes and thereby closing of said skirt along the neck, shoulders and/or arms of the wearer, so as to reconfigure and convert said skirt into a top.

16. The composite garment of claim 15 wherein said bodice has an edge margin and a band of elastic material attached along said edge margin of said bodice so as to allow stretching and clinging of said bodice about the body of the wearer.

17. The composite garment of claim 15 wherein at least top and bottom portions of said tubular-shaped piece of material forming said bodice is elastic so as to allow stretching and clinging of said bodice around regions of the body of the wearer and reconfiguring to wear either above or below the waist of the wearer.

18. The composite garment of claim 15 wherein said bodice has open opposite ends located proximate to and remote from said skirt whose positions that are spaced above and below one another are reconfigured and inverted such that said bodice is configured to be worn in either of an upright or inverted orientation so as to reconfigure said skirt on the wearer to either below or above the bodice.

19. The composite garment of claim 15 wherein a front vertical portion of said bodice is smocked in an elasticated manner.

20. The composite garment of claim 15 wherein said smocked front vertical portion of said bodice is wider at a first end than at a second end thereof.

* * * * *